US006948599B2

(12) United States Patent
Rodrigue et al.

(10) Patent No.: US 6,948,599 B2
(45) Date of Patent: Sep. 27, 2005

(54) SPORTS BAG INSERT

(75) Inventors: Kathleen Rodrigue, Lewiston, ME (US); Kathy Boulet, Lewiston, ME (US)

(73) Assignee: Sports P.A.L. Inc., Lewiston, ME (US)

( * ) Notice: Subject to any disclaimer, the term of this patent is extended or adjusted under 35 U.S.C. 154(b) by 74 days.

(21) Appl. No.: 10/439,255

(22) Filed: May 15, 2003

(65) Prior Publication Data

US 2004/0050638 A1 Mar. 18, 2004

Related U.S. Application Data

(60) Provisional application No. 60/411,662, filed on Sep. 18, 2002.

(51) Int. Cl.[7] ..... A45C 7/00

(52) U.S. Cl. ..... 190/107; 190/109; 190/901; 206/315.1; 383/38; 383/117

(58) Field of Search ..... 206/315.1; 190/107–109, 190/111, 901, 1; 383/6, 37–39, 117, 106

(56) References Cited

U.S. PATENT DOCUMENTS

| | | | | | |
|---|---|---|---|---|---|
| 1,300,921 | A | * | 4/1919 | Briggs | 190/110 |
| 2,107,180 | A | * | 2/1938 | Gihon | 190/110 |
| D140,519 | S | * | 3/1945 | Pascal | D6/320 |
| 2,423,297 | A | * | 7/1947 | Creamer | 206/279 |
| 2,426,843 | A | * | 9/1947 | Phair et al. | 8/137 |
| 3,036,616 | A | * | 5/1962 | Allen | 383/39 |
| 3,139,133 | A | * | 6/1964 | Spector | 190/111 |
| 3,777,862 | A | * | 12/1973 | Zipper | 190/107 |
| 3,837,447 | A | * | 9/1974 | Honan | 190/110 |
| 4,502,576 | A | | 3/1985 | Reardon | |
| 4,580,667 | A | * | 4/1986 | Herwood | 190/110 |
| 4,753,329 | A | | 6/1988 | Choy | |
| 5,238,305 | A | * | 8/1993 | Feller | 383/22 |
| 5,413,199 | A | | 5/1995 | Clement | |
| D368,160 | S | * | 3/1996 | Carretta | D3/286 |
| 5,562,204 | A | | 10/1996 | Sapyta et al. | |
| D388,611 | S | * | 1/1998 | Shaw | D3/303 |
| 5,743,649 | A | * | 4/1998 | Gonzalez | 383/6 |
| 5,779,033 | A | * | 7/1998 | Roegner | 206/6.1 |
| 5,845,780 | A | | 12/1998 | Allen | |
| 6,095,385 | A | | 8/2000 | Utu et al. | |
| 6,129,210 | A | * | 10/2000 | Rustemeyer et al. | 206/736 |
| 6,193,034 | B1 | | 2/2001 | Fournier | |
| 6,523,653 | B2 | * | 2/2003 | Roegner | 190/109 |
| 2002/0074199 | A1 | * | 6/2002 | Albritton | |
| 2003/0183667 | A1 | * | 10/2003 | Mantis | |

FOREIGN PATENT DOCUMENTS

| | | | | |
|---|---|---|---|---|
| JP | 2046892 A | * | 2/1990 | |
| JP | 2001000773 A | * | 1/2001 | D06F/35/00 |
| JP | 2001130587 A | * | 5/2001 | B65D/30/06 |

* cited by examiner

*Primary Examiner*—Sue A. Weaver
(74) *Attorney, Agent, or Firm*—Patricia M. Mathers; Thomas L. Bohan

(57) ABSTRACT

An insert for use with a conventional sports bag for organizing, carrying, drying, and storing sports gear. The insert has mesh pockets, straps for attaching clothing and equipment to the insert, and loops for suspending the insert from a hook. The insert can easily be pulled into a shape that fits into a conventional sports bag. Once inserted into the sports bag, all the pockets on the insert remain fully functional and accessible, with the openings of the large mesh pockets and the full-size mesh pocket being readily accessible from the top of the sports bag.

15 Claims, 2 Drawing Sheets

SPORTS BAG INSERT

This application claims priority under 35 USC §119 of the currently pending provisional application 60/411,662, filed on Sep. 18, 2002.

BACKGROUND INFORMATION

1. Field of the Invention

The invention relates to the field of sports gear. More particularly, the present invention relates to devices for organizing, carrying, drying, and storing sports gear. More particularly yet, the present invention relates to an insert for a sports bag.

2. Description of the Prior Art

Sports bags for organizing, carrying, drying, and storing sports gear are well known (the term "gear" as used hereinafter includes both articles of clothing and sports equipment). The conventional sports bag has several disadvantages. For one, articles of clothing and equipment are stored within the bag in a disorderly fashion, making it difficult to find or extract a particular article quickly without having to remove other articles. For another, the conventional sports bag does not promote proper care of sports gear following a sporting event. For example, articles of clothing and protective gear are frequently moist after they have been used. They are then necessarily tossed in a moist condition into a sports bag that impedes the flow of air through and around the gear stored within. Ideally, the gear is removed from the sports bag as soon as possible and set out to air out. This entails removing each article of clothing and equipment from the bag and laying it out to dry. Many fail to do this in a timely fashion, and, as a result, the sports gear remains in an enclosed area for an extended period of time, in a moist condition, in ideal conditions for the unhealthful and rank-smelling growth of mold, mildew, and fungus.

A further disadvantage of the conventional sports bag is that, once the person using the bag has dutifully removed all the articles from it for proper air-drying, all the articles must be put back into the bag before the next sporting event. It is not uncommon for people to forget to pack a piece of equipment or clothing that is needed for an event. The sports bag itself provides no visual cues as to what may be missing because the bag, being designed for general use, is not constructed to promote organization of gear for a particular sport in a manner that would provide helpful visual cues.

A number of specialty sports bags have attempted to overcome these disadvantages. One sports bag, disclosed in U.S. Pat. No. 6,193,034 (Fournier; 2001) has side and end walls that can be unzipped and opened out, so that the bag takes on a planar configuration. The outer surface of the bag is made of a flexible fabric. Nylon mesh pockets, shaped and sized to hold a specific piece of clothing or equipment, are disposed on the interior surface of the bag. When opened out to the flat configuration, the Fournier bag can be suspended from a hook or the like in order to promote air-drying of the equipment stored within the bag.

This sports bag has several disadvantages. The outer fabric of the bag is not a mesh fabric and, therefore, impedes rapid air-drying of the clothing and equipment stored within the bag. Another problem presented by the Fournier sports bag is that it is cumbersome and unwieldy, and unusable by youngsters who are playing at an introductory level of sports, such as level one hockey. This is because the person using the Fournier bag must be capable of organizing the gear within the boundaries of the bag in its planar configuration, fold up the side walls and end walls of the bag and zipper the respective wall into place, without clothing or gear sliding past the zipper edge of the wall and/or getting caught in the zipper. Zippers are difficult for many children to operate, and the need to hold the respective wall in place in order to pull the zipper closed requires more coordination and facility with zippers than the average seven or eight-year old can manage.

A further disadvantage of the Fournier bag is that it is constructed to carry gear for a particular sport. The bag, thus, may be well-suited for one particular sport, but not for another that requires very different types of clothing and equipment.

U.S. Pat. No. 5,413,199 (Clement; 1995) discloses a bag having an inner mesh bag that can be removed from the outer sports bag. The first disadvantage of sports bags mentioned at the outset of this section applies to this bag. The bag provides essentially a large, unorganized area for storing sports clothing and equipment and, in order to gain access to some articles, others will need to be removed. Also, many of the articles will be stored in close proximity to one another, thereby making it necessary that the articles be removed from the bag if they are to be properly and rapidly air-dried.

Both sports bags discussed above, as well as many other specialty sports bags, have the disadvantage that they require the sports person to use a specialty bag, rather than a conventional sports bag. This is problematic for members of sports teams that use and provide a conventional style sports bag with the team logo or name on it. Also, children often prefer to use a very particular type of sports bag, either a particular brand, or one with a particular logo on it. Having to use a specialty sports bag, rather than the conventional sports bag of one's choice, may give rise to resentment and dissatisfaction.

What is needed, therefore, is a means of organizing, storing, and carrying sports gear that provides quick and easy access to all articles of clothing and equipment at all times. What is further needed is such a means that promotes rapid air-drying of the gear. What is yet further needed is such a means that is easy to manage, even for children and persons of small stature. And, finally, what is needed is such a means that does not require the person using it to forego use of his or her favorite sports bag.

BRIEF SUMMARY OF THE INVENTION

For the reasons cited above, it is an object of the present invention to provide a means that helps organize, carry, and store gear and promotes rapid air-drying of the gear. It is a further object to provide such a means that does not require any particular facility to manipulate, pack, fold, and stow and is, therefore, usable by young children who are of an age to play introductory level sports. It is a yet further object to provide such a means that is usable with a conventional sports bag.

The objects are achieved by providing a sports bag insert that holds articles of clothing and equipment and is folded and inserted into a conventional sports bag. The insert promotes practical organization of the necessary sports gear, provides easy access to the gear, even when folded and stowed in the sports bag, and promotes rapid air-drying of the gear. The sports bag insert according to the invention is easy to use, even for youngsters who are just old enough to play introductory level sports, does not require the use of a specialty sports bag, and also accommodates adult-sized sports gear, as well as gear for children. Furthermore, although the insert promotes practical organization of the gear, it is not so specialized that it is practical for one sport and not for another.

The sports bag insert according to the invention is a flat, triple-section insert that folds to fit into a conventional sports bag. The insert has a front face and a rear face. A number of large pockets, made substantially of a stretchy mesh material, and organizational aids for holding equipment and clothing are provided on the front face of the insert. The insert is lightweight, not bulky, and the large pockets allow free flow of air through or around the sports gear stored within.

A key feature of the insert is the easy access it provides to all pockets and organizational aids, particularly when folded and stowed within a sports bag. In other words, the insert does not need to be removed from the sports bag in order to gain ready access to its contents. This is important because many sports arenas do not provide the space or the facility to allow the individual athletes to hang up such an insert or to lay it out flat in order to use it efficiently.

The triple sections of the insert according to the invention include an upper section with two large mesh pockets, a middle section made of a flexible, water-impermeable fabric, and a lower section with one full-size mesh pocket. The upper and lower ends of the insert are each provided with a large loop from which to suspend the insert from a hook or a coat hanger. Note: the terms "upper" and "lower", as used hereinafter, are referenced from the insert in a suspended orientation such that the two large mesh pockets are at the upper end.

The front and rear faces of the upper and lower sections are made of a mesh fabric that is very stretchy. The large mesh pockets of the upper section have side panels of a water-impermeable flexible fabric. A smaller pocket is sewn onto the outside surface of each of the side panels. Access to the pockets is from the upper edge of the front side of the insert. The full-size mesh pocket in the lower section is similar to the large pockets on the upper section, except that the pocket in the lower section extends over the entire lower section of the insert. This full-size mesh pocket, too, has side panels of a water-impermeable, flexible fabric. Access to this full-size pocket is at the lower edge of the insert.

The middle section of the insert is made of a relatively dimensionally stable, sturdy, lightweight, water-impermeable material, such as polypropylene, and has reinforcing rods inserted in the seams that attach the middle section to the upper section and the lower section, respectively. The rods provide shape retention to the insert, which helps keep the gear situated in the proper places in or on the insert, and also helps to properly place the insert into a sports bag. Without the reinforcing rods, the mesh fabric of the pockets tends to collapse in on itself toward the center of the insert, with the result that the gear stored in the pockets ends up bunched together in the center. The rods are made of a flexible, polymeric material and have rounded ends, so as not to damage the fabric of the insert.

Fabric holders or tabs made of the loop-portion of hook-and-loop type fasteners such as VELCRO® are attached to the front face of the insert and are available for holding articles of clothing in place, such as shirts and socks. Straps are also attached to the front face of the insert for securing pieces of equipment such as gloves, pants, a helmet, etc. to the insert.

As mentioned above, loops for suspending the insert from a hook or coat hanger are attached to the upper section and the lower section. These loops also facilitate pulling the insert into a shape for inserting it into a sports bag. When the upper section and the lower section are pulled up at substantially right angles to the plane of the middle section, the insert has a shape and size that is insertable into the conventional sports bag. When the insert is stowed in the sports bag, the upper and lower sections of the insert are oriented substantially upright and parallel to each other, or folded toward each other, and the upper edge of the upper section and the lower edge of the lower section are both situated at the top of the sports bag. In this configuration, the pocket openings for the two large mesh pockets in the upper section, the side pockets, and the full-size mesh pocket of the lower section are all readily accessible from the top of the sports bag. The middle section forms a base plane that fits on the floor of the sports bag.

DETAILED DESCRIPTION OF THE INVENTION

Figure 2:
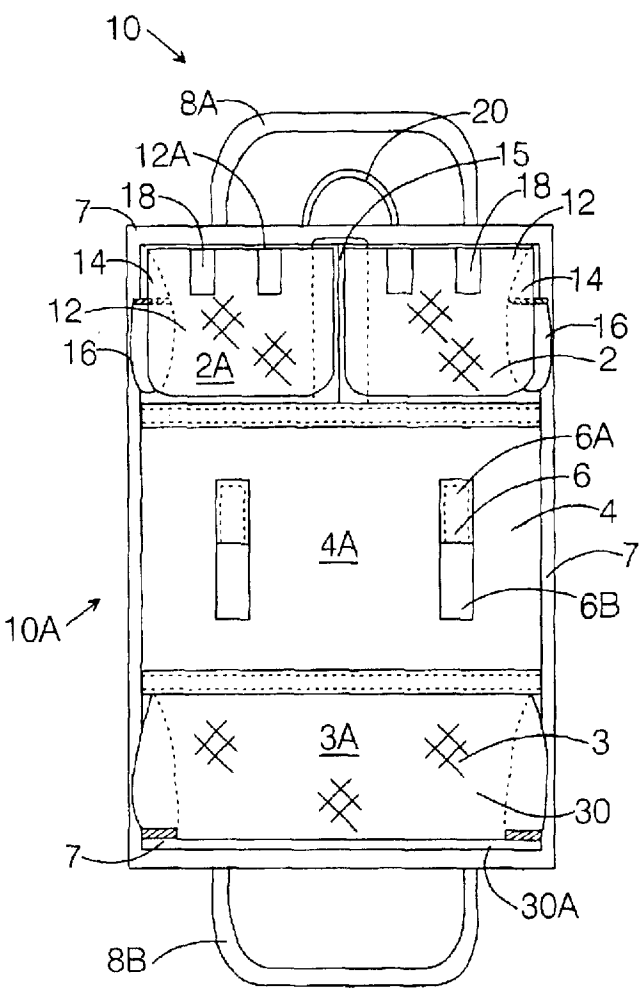
FIG. 2 is an illustration of the front face of the insert of FIG. 1.
Figure 1:
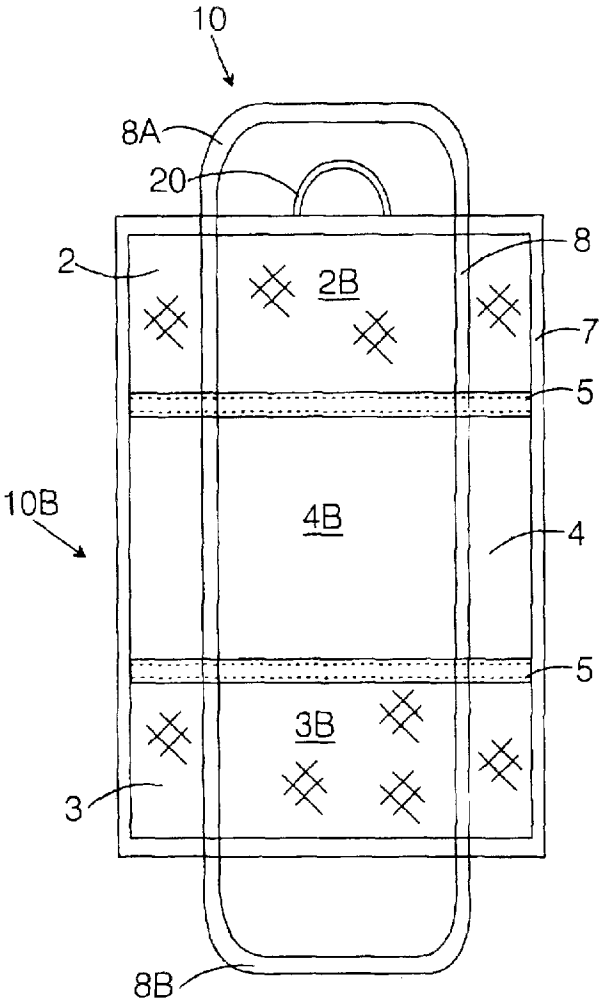
FIG. 1 is an illustration of the rear face of the insert according to the invention.

FIGS. 1 and 2 illustrate a sports bag insert 10 according to the present invention. FIG. 1 shows a rear face 10B of the insert 10 and FIG. 2 a front face 10A. The insert 10 comprises an upper section 2 having an upper front face 2A and an upper rear face 2B, a lower section 3 having a lower front face 3A and a lower rear face 3B, and a middle section 4. An upper loop 8A extends from the upper section 2 and a lower loop 8B from the lower section 3. A small loop 20 extends from the upper section 2. The middle section 4 is attached by means of double seams to the upper section 2 and the lower section 3. Inserted in each seam is a reinforcing rod 5. The edges of the insert 10 are reinforced with an edge-tape 7.

As shown in FIG. 2, two large mesh pockets 12 are disposed on the upper front face 2A and the upper rear face 2B of the insert 10. In the embodiment shown, the sides of the large mesh pockets 12 are formed by outer side panels 14 and inner side panels 15, made of a dimensionally stable, flexible fabric, and a small side pocket 16 is formed on the outside of the side panels 14 In FIGS. 1 and 2, mesh fabric is indicated by cross-hatching on the relevant surface feature of the insert 10. Fabric holders 18 are provided on the insert 10 and, in the embodiment shown, are stitched to an upper edge 12A of the large mesh pockets 12, although it shall be understood that such fabric holders may be arranged on the insert 10 at different locations. The fabric holders 18 are made from the hook material of a conventional fabric hook-and-loop type fastener such as VELCRO®.

The middle section 4 of the insert 10 is made of a dimensionally stable, flexible, water-impermeable fabric. Attached to the middle section are straps 6 for securing articles of clothing or equipment to the insert 10. In the embodiment shown, the straps 6 are made of the conventional VELCRO® type hook-and-loop type fastener, with one half of the strap being the hook portion 6A and the other half the loop portion 6B. FIG. 2 shows two such straps 6 attached to the middle section, whereby it shall be understood that any suitable number of straps may be attached to any suitable surface of the insert 10.

The lower section 3 includes a full-size mesh pocket 30, also made of a stretchy mesh fabric as indicated by the cross-hatching. The opening to the full-size mesh pocket 30 is at the bottom edge 30A. A VELCRO® type or similar fastening material may be provided along the bottom edge 30A so that the full-size mesh pocket 30 is closable if desired.

The edges of the mesh pockets 12 and 30, as well as the outer edges of the insert 10 are reinforced with an edge tape 7. The tape 7 may be a bias tape or any suitable type of material for reinforcing a stitched, flexible edge. The upper loop 8A, lower loop 8B, and small loop 20 are made of a synthetic woven strap material, although it is the intention that any material that is suitable for sturdy straps and loops be included within the scope of the invention.

As shown in FIG. 1, a support strap 8 from which the upper loop 8A and the lower loop 8B are formed is stitched as a continuous strap structure along the rear face 10B of the insert 10. Since the mesh fabric used for the upper section 2 and the lower section 3 is stretchy, stitching the strap along the entire length of the rear face of the insert 10 increases the durability and robustness of the attachment of the loops 8A and 8A to the insert and also imparts some support and shape retention to the insert 10. When the upper loop 8A and the lower loop 8B are pulled toward each other, the support strap 8, together with the reinforcing rods 5, provides support for the upper section 2 and the lower section 3 and brings the insert 10 into the proper shape for insertion into a sports bag.

Figure 3:
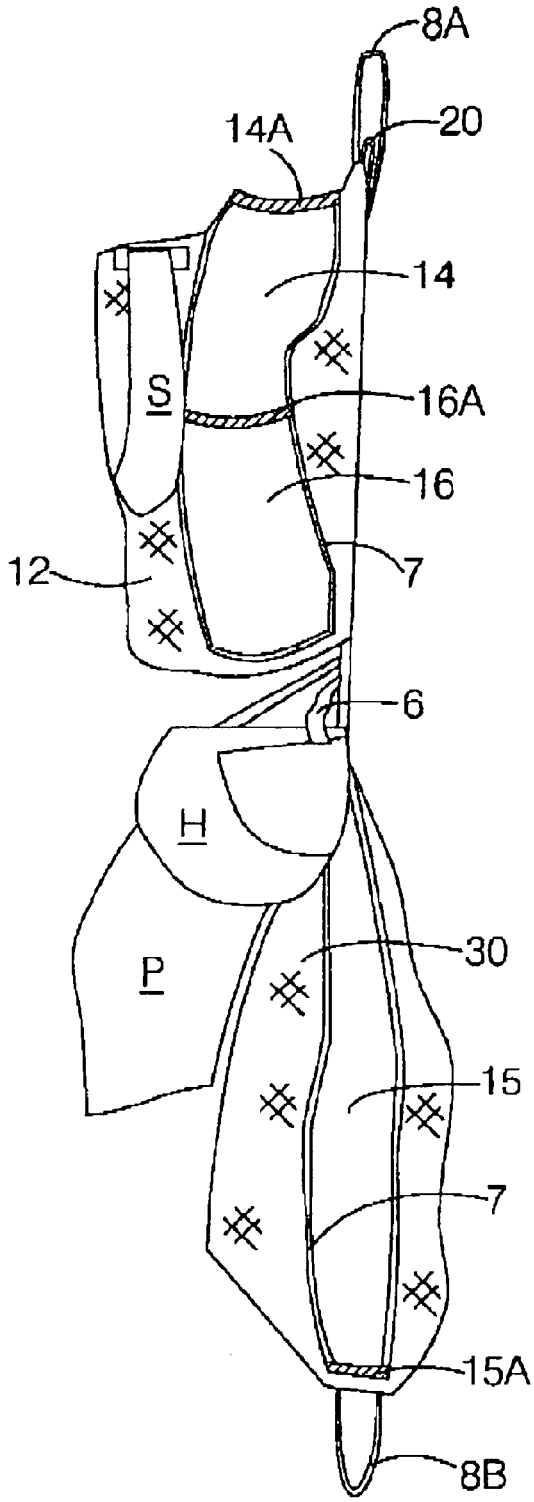
FIG. 3 is in illustration of the insert of FIGS. 1 and 2, suspended from a hook and loaded with sports gear.

FIG. 3 is side view of the insert 10, suspended from the upper loop 8A, and loaded with gear. Clearly visible are the bulging, irregular shapes of one of the stuffed large mesh pockets 12 and the full-size mesh pocket 30, also stuffed with gear. Elasticized edges have been provided on the upper edges of the side panel 14, the side pocket 16, and the side panel 15 (the upper edges are 14A, 16A, and 15A, respectively). The mesh fabric of the mesh pockets 12 and 30 is indicated by cross-hatching. A helmet H is shown secured to the middle section 4 of the insert 10 by means of one of the straps 6. Also shown is protective gear P, secured by the strap 6 (obscured from view by the helmet H). Socks S are attached to one of the fabric holders 18 (obscured from view by sock S). The edge-tape 7 is shown around the edges of the pockets 12 and 30.

Generally, a dimensionally stable, flexible, water-impermeable fabric is used for the side panels 16 and 15 and for the middle section 4. This offers the advantage that water is not absorbed into the fabric, but remains on the surface and dries quickly. Preferably, the fabric is a polypropylene, but it shall be understood that any suitable fabric may be used.

The embodiment of the invention mentioned herein is merely illustrative of the present invention. It should be understood that numerous variations in construction of the present invention may be contemplated in view of the following claims without straying from the intended scope and field of the invention herein disclosed.

What is claimed is:

1. An insert for carrying and storing sports gear, said insert comprising:

a flexible fabric sheet comprising a mesh fabric and a dimensionally-stable fabric, said fabric sheet being substantially flat and having a front surface and a rear surface, an upper edge and a lower edge, and an upper section, a lower section, and a middle section disposed between said upper section and said lower section, said fabric sheet having a width dimension;

wherein said front surface and said rear surface of said upper section are made of said mesh fabric and said upper section includes said upper edge, a first loop extending from said upper section, and an upper pocket;

wherein said front surface and said rear surface of said lower section are made of said mesh fabric and said lower section includes said lower edge, a second loop extending from said lower section, and a lower pocket; and wherein a reinforcing rod is disposed in said middle section, said reinforcing rod having a length corresponding substantially to said width dimension of said fabric sheet and extending across said fabric sheet.

2. The insert of claim 1, wherein said fabric sheet has an intermediate upper edge at a junction between said upper section and said middle section and an intermediate lower edge at a junction between said lower section and said middle section;

wherein said reinforcing rod includes an upper rod and a lower rod; and wherein said lower rod is disposed in said intermediate lower edge and said upper rod is disposed in said intermediate upper edge.

3. The insert of claim 1, wherein said fabric sheet is suspendable from said first loop and/or said second loop.

4. The insert of claim 1, wherein said first loop and said second loop are formed by stitching a fabric band onto said rear surface of said upper section, said lower section, and said middle section in a continuous-loop configuration that forms along said rear surface of said fabric sheet two reinforcing bands, said upper loop, and said lower loop.

5. The insert of claim 1, wherein, in said upper section, said rear surface includes a rear layer and said front surface a front layer, and wherein said upper pocket includes two front-facing upper pockets formed by said front layer and said rear layer, said two front-facing pockets being disposed side-by-side and an internal pocket area of each of said front-facing upper pockets being accessible from said upper edge.

6. The insert of claim 5, wherein said front-facing pockets have side surfaces formed of said dimensionally-stable flexible fabric.

7. The insert of claim 6, wherein at least one of said side surfaces of each of said front-facing pockets has a side pocket with an upper pocket edge, and wherein an internal area of said side pocket is accessible from a direction from said upper edge at said upper section.

8. The insert of claim 1, wherein, in said lower section, said rear surface includes a rear layer and said front surface a front layer, wherein said lower pocket is formed by said front layer and said rear layer, and wherein an internal pocket area of said lower pocket is accessible from said lower edge.

9. The insert of claim 8, wherein said lower pocket has side surfaces formed of a dimensionally-stable flexible fabric.

10. The insert of claim 9, wherein at least one of said side surfaces of said lower pocket has a side pocket with a pocket opening-edge, and wherein an internal area of said side pocket is accessible through said opening-edge from a direction from said lower edge.

11. The insert of claim 1, wherein said dimensionally-stable fabric is water-impermeable.

12. The insert of claim 1, wherein said mesh fabric is a stretchy fabric.

13. The insert of claim 1, wherein said fabric sheet is substantially rectangular in shape; and, wherein, when said upper loop and said lower loop are brought into an overlying position, said fabric sheet is pulled into an insert configuration that is insertable into a conventional sports bag.

14. The insert of claim 13, wherein, when said fabric sheet is inserted into said sports bag, said lower edge and said upper edge of said fabric sheet are facing upward toward a conventional top opening of said sports bag.

15. The insert of claim 1, wherein said middle section is made of dimensionally stable fabric.

* * * * *